US008335665B2

(12) United States Patent
Zhao

(10) Patent No.: US 8,335,665 B2
(45) Date of Patent: Dec. 18, 2012

(54) APPARATUS AND METHOD FOR HIGH RESOLUTION MEASUREMENTS FOR DOWNHOLE TOOLS

(75) Inventor: Jinsong Zhao, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 648 days.

(21) Appl. No.: 12/346,604

(22) Filed: Dec. 30, 2008

(65) Prior Publication Data

US 2010/0169052 A1 Jul. 1, 2010

(51) Int. Cl.
*H03F 1/26* (2006.01)
*H04B 3/46* (2006.01)
*G08C 19/16* (2006.01)

(52) U.S. Cl. ..... 702/191; 375/227; 340/870.25

(58) Field of Classification Search ..... 702/191, 702/1–2, 6, 11–14, 17, 46–47, 69, 75, 78–79, 702/81, 84–85, 98–99, 106, 127, 130, 138, 702/176, 182–183, 189–190, 193; 73/152.46, 73/152.51; 367/25–27, 69, 78–83; 375/225–227; 340/853.1–853.2, 855.3–855.4, 870.12–870.13, 340/870.18–870.19, 870.2, 870.25–870.26; 331/1 R, 18, 23, 34, 40, 44–45, 47, 51
See application file for complete search history.

(56) References Cited

U.S. PATENT DOCUMENTS

| | | | | |
|---|---|---|---|---|
| 3,984,777 | A * | 10/1976 | Noguchi | 375/332 |
| 4,001,775 | A * | 1/1977 | Sexton et al. | 367/83 |
| 4,179,670 | A | 12/1979 | Kingsbury | |
| 4,568,932 | A * | 2/1986 | Flagg | 340/855.5 |
| 6,907,553 | B2 | 6/2005 | Popplewell et al. | |
| 7,293,054 | B2 | 11/2007 | Clements et al. | |
| 7,313,052 | B2 * | 12/2007 | Fincher et al. | 367/83 |

OTHER PUBLICATIONS

Jiang et al., The High-precise Two-Way Time Transfer Based on the Multiphase Pulses Correlation, Apr. 21-24, 2008, International Conference on Microwave and Millimeter Wave Technology, ICMMT 2008, vol. 2, 4 pp.*

Jiang et al., The High-precise Two-Way Time Transfer Based on the Multiphase Pulses Correlation, Apr. 21-24, 2008, International Conference on Microwave and Millimeter Wave Technology, ICMMT 2008, Abstract.*

* cited by examiner

*Primary Examiner* — Toan Le
(74) *Attorney, Agent, or Firm* — Cantor Colburn LLP

(57) ABSTRACT

An apparatus and a method for reducing phase noise in measurement signals from a sensor are provided. The apparatus and method, in one aspect, may use a multiphase counter to obtain a count for each sensor signals time cycle and a filter to reduce noise from the obtained counts. A suitable reference frequency, including the reference frequency of the sensor, may be utilized by the multiphase counter.

22 Claims, 4 Drawing Sheets

APPARATUS AND METHOD FOR HIGH RESOLUTION MEASUREMENTS FOR DOWNHOLE TOOLS

FIELD OF THE DISCLOSURE

1. Field of the Disclosure

This disclosure relates generally to apparatus and method for providing high resolution measurements relating to downhole measurements.

2. Background of the Disclosure

Wellbores (also referred to as "boreholes") are drilled in the earth's subsurface formations for the production of hydrocarbons (oil and gas). A variety of measurements, including pressure and temperature measurements, are made while drilling the wellbore and after the wellbore has been drilled. The measurements made during drilling are generally referred to as measurement-while-drilling while measurements made after drilling are generally referred to as well-logging measurements. A downhole tool, generally referred to as the formation testing tool, is used to withdraw formation fluid samples and to take pressure and temperature measurements while logging the well as well as while obtaining the formation fluid samples. Quartz pressure and temperature sensors are sometimes used to obtain high resolution measurements. Often a trade-off is made between the data resolution and sampling rate. For example, for certain commercially available quartz pressure sensor to obtain a high resolution, such as 0.001 psi, the gate time is often no less that 1 second. When the sampling rate of eight samples per second (for example) is desired, the resolution drops to about 0.01 psi. In some applications, such as during draw down of the formation fluid samples, current downhole tools often use eight samples per second during draw down and fast-build-up phases and then use one sample per second for stable build-up phases. In such measurements, the quantization error (resolution) effect is larger in the areas with a sampling rate of eight samples per second than in the areas with samples of one per second. High quantization error can reduce the data test confidence as well can cause some difficulties during post-processing of the data.

Therefore, there is a need for improved apparatus and method to provide high resolution downhole measurements, including pressure and temperature measurements.

SUMMARY OF THE DISCLOSURE

In one aspect, the disclosure herein provides a method for reducing phase noise in a measurement signal that may include: receiving a measurement signal from a senor, the signal having a plurality of signal cycles; obtaining a count rate for the signal cycle in the plurality of signal cycles using a multiphase counter based on a selected reference frequency to generate a first series of count rates corresponding to the plurality of signal cycles; and reducing phase noise in the measurement signal using the first series of count rates.

In another aspect, the disclosure herein provides an apparatus that may include a frequency generator configured to provide reference frequency signals; and a multiphase counter configured to provide a count rate for each timing signal corresponding to a plurality of signal cycles of a measurement signal obtained from a sensor, using the reference frequency.

Examples of certain aspects of a method and an apparatus for reducing phase noise of a measurement signal have been summarized rather broadly in order that the detailed description thereof that follows may be better understood and in order that the contributions they represent to the art may be appreciated. There are, of course, additional features of the disclosure that will be described hereinafter and which will form the subject of claims of this application.

BRIEF DESCRIPTION OF THE FIGURES

For detailed understanding of the various features of the apparatus and methods described herein, reference should be made to the following detailed description, taken in conjunction with the accompanying drawing in which like elements are generally designated by like numerals and wherein.

DETAILED DESCRIPTION OF THE DISCLOSURE

The disclosure herein is described in reference to a wireline formation testing tool that may measure pressure and temperature in a wellbore for ease of explanation. The various aspects of the disclosure herein apply equally to other sensor measurements. The tool shown and described may be utilized alone in a wellbore or it may be run as a part of a wireline tool string that includes other wireline logging tools. The tool may also be a part of a drilling assembly for taking measurements during drilling of the wellbore. Additionally, the specific embodiments described herein are not to be construed as limitations.

Figure 1:
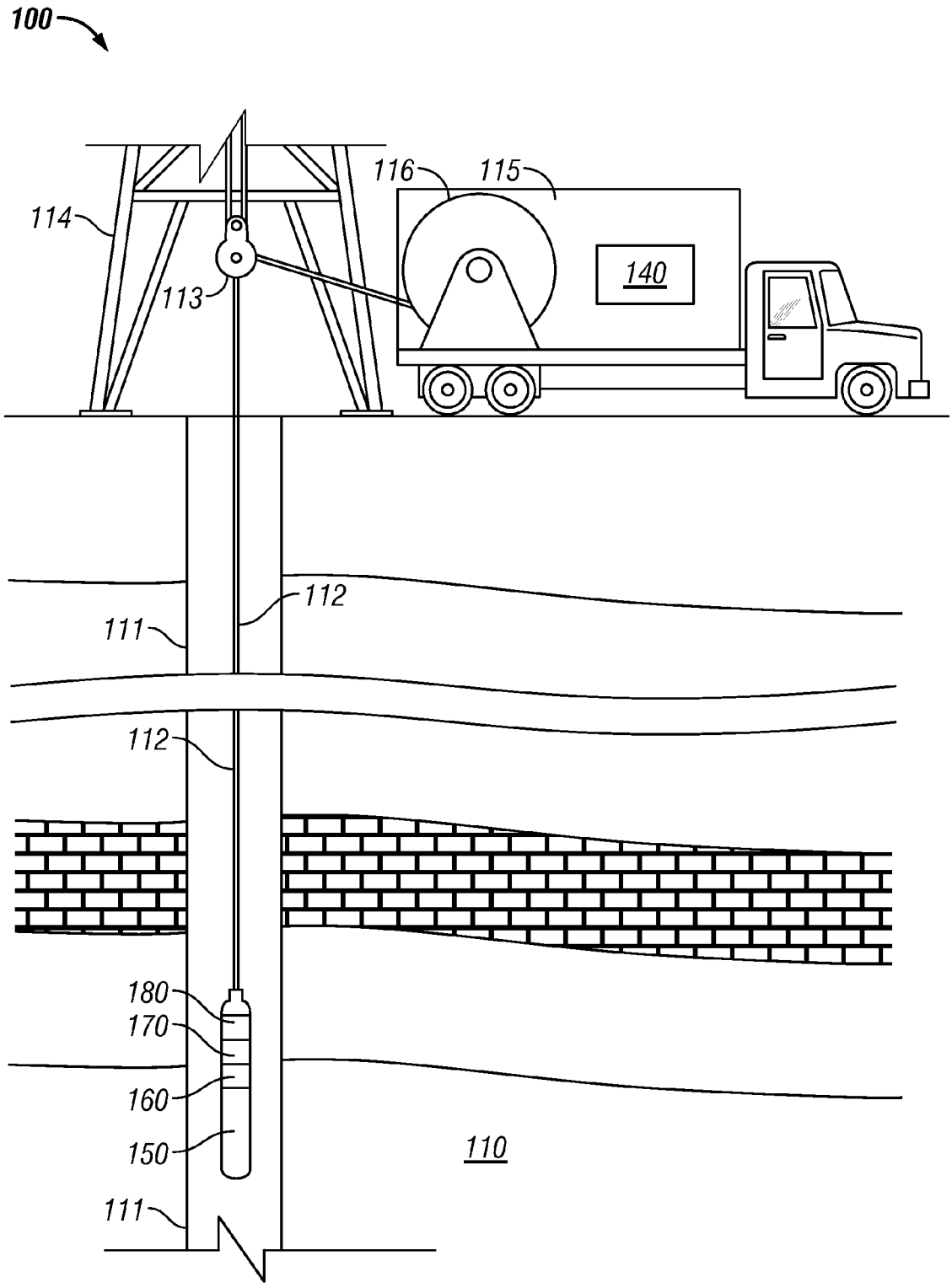
FIG. 1 is a schematic illustration of a formation evaluation tool conveyed in a wellbore obtaining downhole measurements, including pressure and temperature measurements according to one embodiment of the disclosure.

FIG. 1 is a schematic diagram of wireline system 100 configured to make downhole measurements, such as pressure and temperature, using a pressure and temperature gauge, such as a quartz gauge. The apparatus and methods disclosed herein equally apply to such gauges used to make measurements during drilling of the wellbores. Additionally, the methods and apparatus described herein relating to reducing phase noise described herein may be utilized to reduce phase noise of any other sensor measurements. The system 100 is shown to include a downhole tool 150 conveyed into a wellbore 111 formed in an earth formation 110. The tool 150 may be conveyed in the wellbore alone or as apart of a tool string by a suitable conveying member 112, such as a wireline or tubing. The tool 150 may be conveyed into the wellbore 111 from the surface by a surface rig 114 using a winch 116 placed on a surface unit 115 (such as a truck) and a pulley 113 placed on the rig 114. A tubing-conveyed system will generally include an injector (not shown) to convey the tubing and the tool 150 in the wellbore 111. Offshore systems will include a wireline unit or an injector stationed on an offshore rig. Power to the tool 150 and data communication between the tool 150 and the surface unit 115 may be provided via suitable conductors in the conveying member 112. The surface unit 115 may include a control unit or controller 140, which may be a computer-based system, for controlling the operations of the tool 200. Controller 140 further may include a processor 142, one or more data storage devices 144, such as magnetic tapes, solid state memories, hard dicks, etc. configured to store data and computer programs 146 accessible to the processor 142; data input devices, such a keyboards (not shown); display devices (not shown), such as monitors; and other circuitry configured to control the operations of the tool 150 and to process data received from the tool 150. The tool 150 may be utilized to take measurements, such as pressure and temperature, continuously or substantially continuously while logging the wellbore 111 or at selected locations. Often, such measurements are made for a selected time period at selected downhole locations of wellbore depths during drawdown of the fluid samples from the formation to perform reservoir analysis. High resolution measurements are often desirable for such analysis. In many tools, high resolution quartz oscillator pressure and temperature sensors are utilized to take such measurements.

Still referring to FIG. 1, the tool 150 is shown to include a sensor 160 that provides measurements of a selected downhole parameter, such as pressure, temperature, or another parameter. A control unit or controller 180 in the tool may control the operation of the tool and process data from the tool 150. The tool 150 may further include a device including programs (referred herein as the "high resolution device" or "high resolution system") configured according to one aspect of the disclosure to increase the resolution of the measurements provided by the sensor 160. In one aspect, the high resolution device 160 may process measurement signals from the sensor 160 in-situ and provide the processed signals to the controller 180 for further processing. The controller 180 may include a processor 182, a data storage device 184, such as a memory device, and programs 186 for use by the processor 182. The processor 182 may process the data received from the high resolution device 170 and transmit the processed data to the controller 140 via a suitable telemetry unit 190. The data from the high resolution device may be processed by the surface controller 140 or by a combination of the downhole controller 180 and the surface controller 140. The high resolution device 160 may be located at any suitable location, including at the surface equipment. The high resolution device and its operations are described in more detail in reference to FIGS. 2-5.

Figure 2:
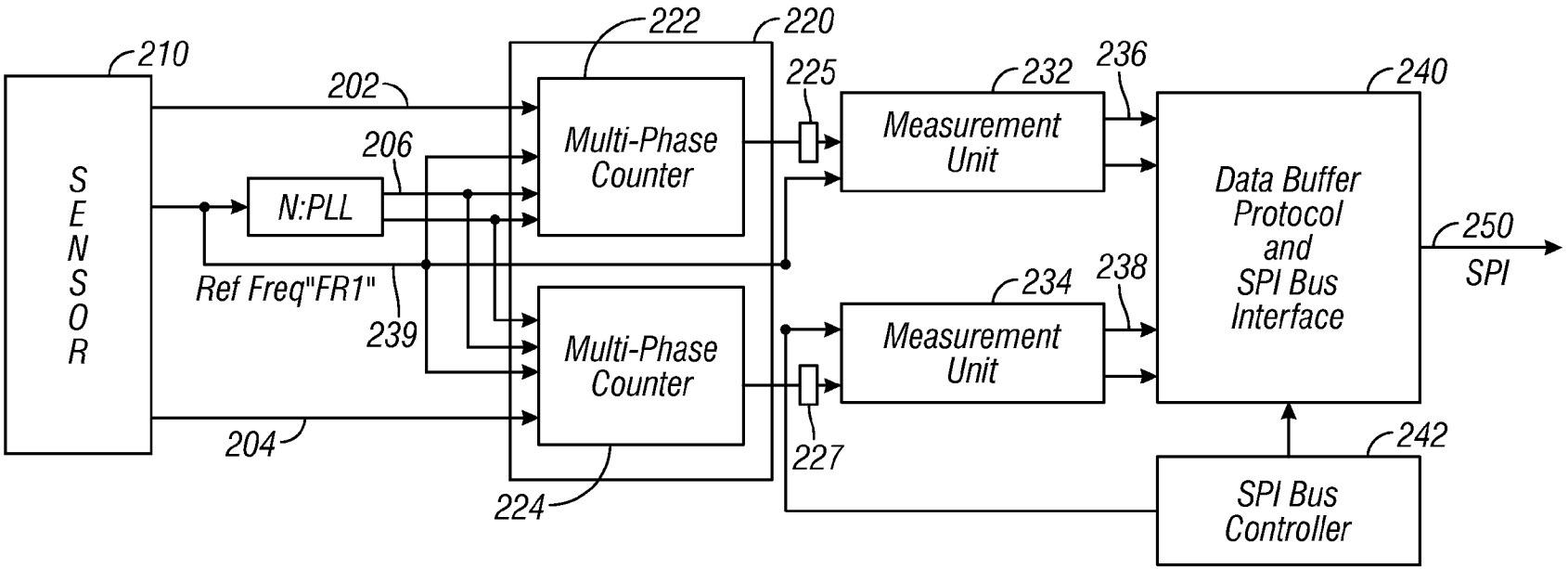
FIG. 2 shows a block diagram of a high resolution measurement system, according to one embodiment of the disclosure.

FIG. 2 shows a block diagram of a system 200 for improving resolution of a sensor measurement according to one embodiment of the disclosure. The system 200 is shown to include a sensor 210 that provides measurement signals for one or more parameters of interest. As an example, system 200 show two measurement signals, one for pressure 202 and the other for temperature 204. Each sensor measurement may be in the form of signals within a predetermined frequency range, such as between 10 KHz and 100 KHz, for example or another suitable frequency range. The sensor 210 may also provide a suitable reference frequency "Fr1." A frequency multiplier or booster 220 may be utilized to boost the reference frequency Fr1 by a selected factor "N," which for the purpose of explaining the system 200 is chosen to be 16. Any other suitable frequency multiplier, however, may be utilized for the purpose of this disclosure. The sensor pressure output signals 202 and temperature output signals 204 and the boosted reference frequency signal 206 are shown as input to a multiphase counting device 220, which may comprise a separate multiphase counter 222 for the pressure measurements 202 and a multiphase counter 224 for the temperature measurements 204. The multiphase counter 220 provides as outputs counts corresponding to the pressure measurements 202 and the temperature measurements 204 based on a reference frequency Fr1, the multiplier N and the number of phases "P" of the counters 222 and 224. Suitable filters 225 and 227 respectively reduce the phase noise associated with the pressure measurements 202 and temperature measurements 204, using the output from the multiphase counters 220 and 224 respectively. Measurement units 232 and 234 respectively reconstruct the pressure measurement signals and temperature measurement signal of the sensor 210 as reduced phase-noise-pressure signals 236 and reduced-phase-noise temperature signals 238. The signals 236 and 238 and the reference frequency 239 of the sensors 210 is fed to a data buffer and bus interface unit 240, which provides the pressure and temperature signals according to a desired protocol, such as a serial protocol. A protocol interface controller 242 controls the data buffer and interface unit 240. The system 200 is described herein in reference to a pressure and temperature measurement for ease of explanation. The system 200, however, is applicable to any sensor measurement and may utilize any number of sensor measurements as the input. The operations of the various components of the system 200 are described in more detail in reference to FIGS. 3-6.

Figure 3:
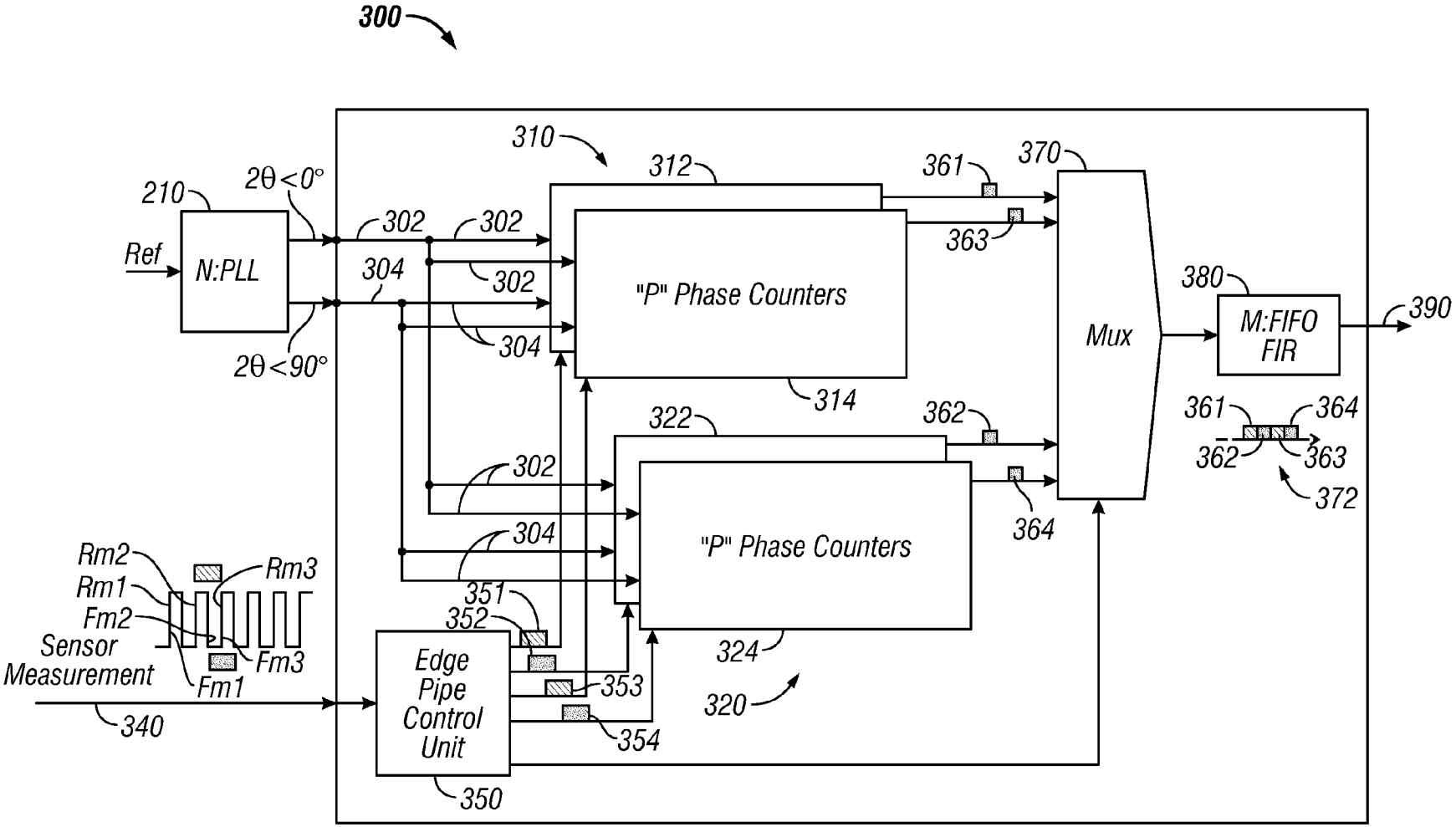
FIG. 3 shows a block diagram of a dual-channel pipelined unit that may be utilized in the system of FIG. 2, according to one embodiment of the disclosure.

FIG. 3 shows a block diagram of multi-channel, multiphase pipelined system 300 that may be utilized to reduce phase noise from the sensor signals 202, 204, etc. For ease of explanation, the system 300 is shown for a single sensor measurement. Furthermore the numerical values relating to the signals, reference frequency, frequency multipliers, time periods, etc. are used for ease of explanation and not as limitations. The system 300 is shown to include two channels 310 and 320, channel 310 having counters 312 and 314 and channel 320 having counters 322 and 324. The reference multiplier 210 generates a reference frequency Fr2=Fr1×N Hz. This Fr2 frequency may further be split corresponding to the rising and falling edges of the cycles of the frequency Fr2 signals, before it is supplied to counters 312 and 314 of channel 310 and counters 322 and 324 of channel 320.

Figure 4:
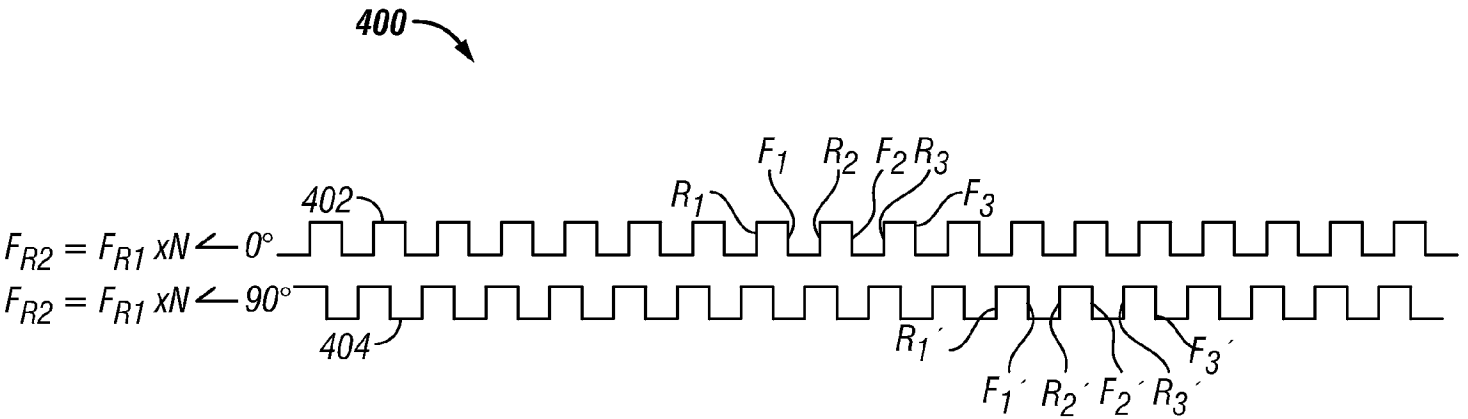
FIG. 4 is an exemplary frequency signals corresponding to rising and filing edges of the reference frequency for use by multiphase counters shown in FIG. 2, according to one aspect of the disclosure.

FIG. 4 shows pulse sequences 402 and 404 corresponding to zero degree and ninety degree phases of the reference frequency Fr2 respectively that may be utilized to generate multiphase frequencies for use by the counters 312, 314, 322 and 324 shown in FIG. 3. In one aspect, the signals supplied to each counter using the pulse sequence 402 may correspond to the rising edges and falling edges of the cycles in the pulse sequence 402. For example, the signals supplied from the sequence 402 may correspond to the rising edges R1-R2, R2-R3, etc and falling edges F1-F2, F2-F3, etc. Thus, in this example there will be two times the signals provided to each counter of each channel corresponding from the pulse sequence Fr2 402 at zero degree phase, as shown by line 302. Similarly, the signals supplied using the pulse sequence 404 corresponding to ninety degree phase may correspond to the rising edges R1'-R2', R2'-R3', etc. and falling edges F1'-F2', F2'-F3', etc. Thus, in this particular example, each counter 312 and 314 in the first channel 310 and each counter 322 and 324 in the second channel 320 will receive four "P" reference frequencies Fr3, two corresponding to the pulse sequence 402 and two corresponding to the pulse sequence 404. Therefore, each of the phase counters 312, 314, 322 and 324 will provide a count based on the frequency Fr3=Fr1×N×P, where Fr1 is the initial reference frequency (such as supplied by the sensor 201), N is the frequency multiplier (such as by the multiplier 210) and P is the number of phases in the multi-phase counter (such as counters 312, 314, 322 and 324). In some applications, the value of N, however, may be zero and the number of phase may be more or less than four. Any suitable frequency multiplier may be utilized, including but not limited to, a phase-locked loop device.

Figure 5:
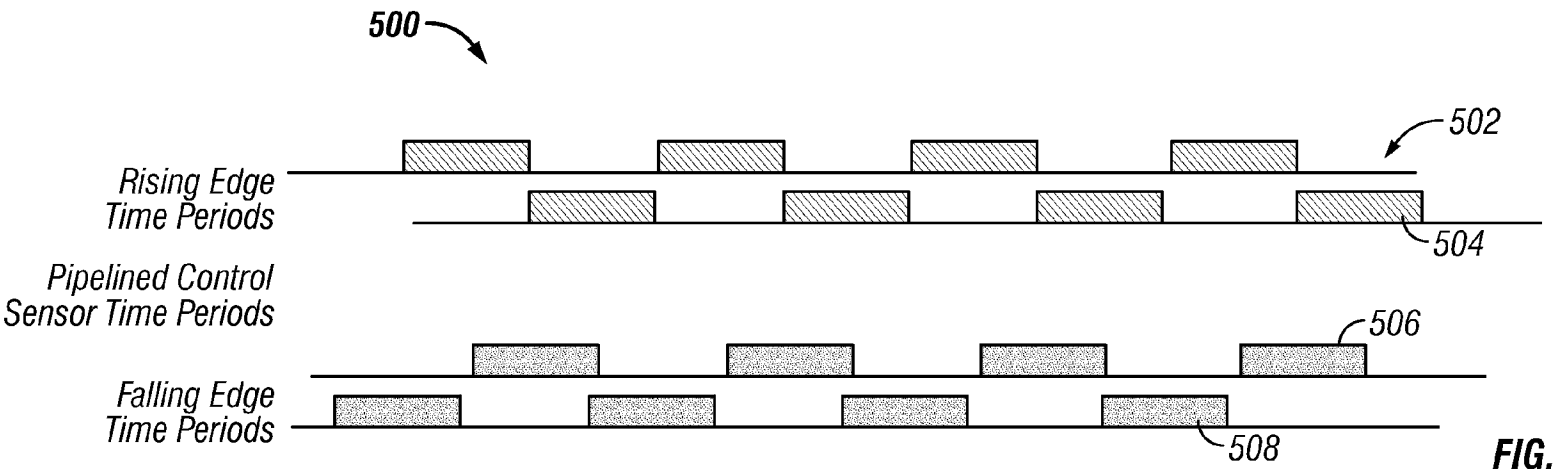
FIG. 5 shows an exemplary timing diagram corresponding to the rising and falling edges of sensor measurement signals that may be utilized for pipelining the measurement signal for use by the system shown in FIG. 2.

Referring back to FIG. 3, the system 300, in one aspect, may pipeline the time periods associated with the sensor measurement signals 315 before sending such time periods to the multi-phase counters 312, 314, 322 and 324. FIG. 3 shows an exemplary signal sequence 340 from the sensor 201 corresponding to a particular measurement, such as pressure, temperature or another desired parameter. In one aspect, a control unit 350 (also referred herein as edge pipeline control unit) may generate timing signals using the measurement pulse sequence 340 and sequentially supply such generated timing signals to the counters. For example the control unit 350 may generate a first timing signal 351 equal to a first rising edge cycle, such as between Rm1 and Rm2 and provide it to the first counter 312 of the first channel 310, the second timing signal 352 equal to the first falling edge cycle between Fm1 and Fm2 and route it to the first counter 322 of the second channel 320, the third timing signal 353 equal to the second rising edge cycle between Rm2 and Rm3 and route it to the second counter 314 of the first channel 310 and the fourth timing signal 354 equal to the second falling edge cycle between Fm2 and Fm3 and route it to the second counter 324 of the second phase counter 320, and so on. In this manner, the control unit 350 may sequence the rising edge timing signals (or rising edge time periods) and falling edge timing cycles (or falling edge time periods) associated with the sensor measurement signals 340 to the multiphase counters 310 and 320. In this particular edge control pipeline example, the number of time periods provided to the phase counters 312, 314, 322 and 324 will be twice the number of time cycles in the sensor measurement signals 240. FIG. 5 shows a timing diagram for the time signals that may be generated and sequenced or pipelined by the control unit 350 according to one aspect of the disclosure. Timing signals 502 and 504 correspond to alternate rising edges while timing signals 506 and 508 correspond to the alternate falling edges of the measurement signals 340. Each phase counter then provides a count for the time period provided thereto based on the reference frequency Fr3=Fr1×N×P. For example counter 312 will provide a count rate 361 for the time period 351, counter 322 will provide a count rate 362 for the time period 352, counter 314 will provide a count rate 363 for the time period 353 and counter 324 will provide a count rate 364 for time period 354 and so on. Since the time periods (such as 351, 352, 353, 354, etc.) provided to the phase counters are twice the number of time periods in the measurement signal 340 (one corresponding to the rising edges and one corresponding to the falling edges), the phase counters will provide twice the count rates compared to the cycles in the measurement signal 340. Also, as an example, when N=16 and P=4, the effective sampling rate of each phase counter will be 16×4=64 times the reference frequency, such as sensor reference frequency. As an example, if the sensor reference frequency is 7.2 MHz, the sampling frequency for the phase counters will be 7.2×16×4=460.8 MHz. A multiplexer 370 may be utilized to sequence the count rates from the phase counters as shown by sequence 372. A filter 380 may be utilized to reduce the phase noise from the count rates 372. The filter, in one aspect, may provide a running average over a selected time period M using a first-in first-out method. Any suitable filter, including but not limited to, a finite impulse response filter, may be utilized for the purpose of this disclosure. The output from the filter 380, i.e., phase noise reduced count rates may be processed to reconstruct the sensor signals having reduced phase noise, as described above in reference to FIG. 2.

Thus, the disclosure in one aspect provides a method for reducing phase noise in a measurement signal that may include: receiving a measurement signal from a senor, the signal having a plurality of signal cycles; obtaining a count rate for the signal cycle in the plurality of signal cycles using a multiphase counter based on a selected reference frequency to generate a first series of count rates corresponding to the plurality of signal cycles; and reducing phase noise relating to the measurement signal using the first series of count rates. In another aspect, the method may further include: generating a second series of count rates having reduced phase noise; and reconstructing the measurement signal with reduced phase noise using the second series of count rates. The reference frequency may correspond to one of: (i) a reference frequency of the sensor; (ii) a boosted reference frequency of the sensor; and (iii) a frequency generated independent of a sensor reference frequency. In another aspect, the method may further include: generating a plurality of pipelined timing signals representing the plurality of signal cycles; and providing the plurality of the pipelined timing signals to the multiphase counter. In another aspect, generating the plurality of pipelined timing signals may include generating alternately timing signals corresponding to rising edges and falling edges of the signal cycles in the plurality of signal cycles.

In another aspect, the method may further include splitting the reference frequency into a plurality of phases before providing the reference frequency to the multiphase counter. The reference frequency, in one aspect, may be split by generating a frequencies corresponding to a reference of a zero degree phase and a frequency corresponding to a ninety degree phase. In another aspect, the splitting the reference frequency may be done by generating a first frequency signal corresponding to the rising edges of the plurality of signal cycles and a second frequency signal corresponding to the falling edges of the plurality of signal cycles. The phase noise may be reduced by averaging count rates in the second series of count rates over a selected time period. Also, in general, the multiphase counter may sample each timing signal at a rate that equals N×P×reference frequency of the sensor, where N may be zero or an even integer and P is an even integer.

In another aspect, the disclosure herein provides an apparatus that may include: a frequency generator configured to provide reference frequency signals; and a multiphase counter configured to provide a count rate for each timing signal corresponding to a plurality of signal cycles of a measurement signal obtained from a sensor, using the reference frequency. In another aspect, the apparatus may further include an edge pipe control unit that generates timing signals corresponding to the plurality of signal cycles of the measurement signal. In one aspect, the edge pipe control unit may generate the timing signals corresponding to rising and falling edges of the plurality of signal cycles of the measurement signal. The frequency generator may generate the reference frequency signals corresponding to the rising and falling edges of one of: (i) a sensor reference frequency signal; (ii) a boosted sensor reference frequency signal; and (iii) a frequency signal independent of a reference frequency signal of the sensor. In another aspect, the frequency generator may generate the reference frequency signals corresponding to a zero degree phase and a ninety degree phase of a preexisting frequency signal.

In another aspect, the multiphase counter may generate the count rates that comprise alternate count rates corresponding to rising and falling edges of the plurality of signal cycles of the measurement signal. The apparatus may further include a multiplexer that may sequence the count rates from the multiphase counter to provide a series of count rates that includes alternate count rates corresponding to the rising and falling edges of the plurality of signal cycles of the measurement signal. A suitable filter may be utilized to reduce phase noise from the measurement signal using the series of count rates provided by the multiplexer and provide a reduced phase noise series of count rates. A measurement device may be utilized to reconstruct the measurement signal from the reduced phase noise series of count rates provided by the filter. In another aspect, the multiphase counter may include a plurality of channels, each channel having a plurality of phases.

In another aspect, the disclosure provides a tool for use in a wellbore. The tool in one configuration may include: a senor configured to obtain a measurement downhole and to provide a corresponding measurement signal having a plurality of signal cycles; a device configured to reduce phase noise from the measurement signal, the device including a frequency generator configured to provide reference frequency signals; and a multiphase counter configured to provide a count rate for each timing signal corresponding to the plurality of signal cycles using the reference frequency signal. The tool may further include a filter that reduces phase noise from the measurement signal using the count rates provided by the multiphase counter. The sensor may be any sensor, including, but not limited to, a pressure sensor and a temperature sensor.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A method of reducing phase noise of a measurement signal of a sensor, comprising:

receiving a measurement signal having a plurality of signal cycles from the sensor;

receiving a reference signal having a reference frequency relating to the measurement signal;

obtaining count rates over a time period for a signal cycle in the plurality of signal cycles using a plurality of signals based on the reference signal;

sequentially arranging the obtained count rates in a first series of count rates; and reducing the phase noise of the measurement signal using the first series of count rates.

2. The method of claim 1 further comprising:

generating a second series of count rates having the reduced phase noise; and reconstructing the measurement signal with the reduced phase noise using the second series of count rates.

3. The method of claim 2, wherein reducing the phase noise comprises averaging count rates in the second series of count rates over a selected time period.

4. The method of claim 1, wherein the reference frequency corresponds to one of: (i) a reference frequency of the sensor; (ii) a boosted reference frequency of the sensor; and (iii) a frequency generated independent of a sensor reference frequency.

5. The method of claim 1 further comprising:

generating a plurality of pipelined timing signals representing the plurality of signal cycles; and providing one of the plurality of pipelined timing signals to a selected multiphase counter and providing another of the plurality of the pipeline timing signals to another multiphase counter.

6. The method of claim 5, wherein generating the plurality of pipelined timing signals comprises generating timing signals corresponding to rising edges and falling edges of the signal cycles in the plurality of signal cycles.

7. The method of claim 1 further comprising splitting the reference signal into a plurality of signals having separate phases and providing the plurality of signals to the multiphase counter.

8. The method of claim 7, wherein splitting the reference signal further comprises generating a signal having a zero degree phase of the reference signal and a signal having a ninety degree phase of the reference signal.

9. The method of claim 7, wherein splitting the reference frequency further comprises generating a first signal corresponding to the rising edges of the plurality of signal cycles and a second signal corresponding to the falling edges of the plurality of signal cycles.

10. The method of claim 1, wherein the multiphase counter samples each timing signal at a rate that equals N×P×reference frequency of the sensor, where N may be zero or an even integer and P is an even integer.

11. An apparatus for use in a wellbore, comprising:

a frequency generator configured to provide a reference frequency of a sensor measurement signal; and a multiphase counter configured to provide a count rate for each of a plurality of timing signals of a measurement signal obtained from a sensor, using a time period based on the reference frequency; and a multiplexer configured to sequentially arrange the count rates in a first series of count rates.

12. The apparatus of claim 11 further comprising an edge pipe control unit that generates the plurality timing signals.

13. The apparatus of claim 12, wherein the edge pipe control unit generates the plurality of timing signals using rising and falling edges of signal cycles of the measurement signal.

14. The apparatus of claim 11, wherein the frequency generator generates the reference frequency signals corresponding to rising and falling edges of one of: (i) a sensor reference frequency signal; (ii) a boosted sensor reference frequency signal; and (iii) a frequency signal independent of a reference frequency signal of the sensor.

15. The apparatus of claim 14, wherein the multiphase counter generates the count rates that comprise alternate count rates corresponding to rising and falling edges of the plurality of signal cycles of the measurement signal and wherein the apparatus further comprises a multiplexer that sequences the count rates from the multiphase counter to provide a series of count rates that includes alternate count rates corresponding to the rising and falling edges of the plurality of signal cycles of the measurement signal.

16. The apparatus of claim 15 further comprising a filter that reduces phase noise relating to the measurement signal using the series of count rates and provides a reduced phase noise series of count rates.

17. The apparatus of claim 16 further comprising a measurement device that reconstructs the measurement signal using the reduced phase noise series of count rates.

18. The apparatus of claim 11, wherein the frequency generator generates the reference frequency signals corresponding to a zero degree phase and a ninety degree phase of a preexisting frequency signal.

19. The apparatus of claim 11, wherein the multiphase counter comprises a plurality of channels, each channel having a plurality of phases.

20. A tool for use in a wellbore, comprising:

a sensor configured to obtain a measurement downhole and to provide a measurement signal having a plurality of signal cycles;

a device configured to reduce phase noise from the measurement signal, the device including:

a frequency generator configured to provide a reference frequency signal relating to the measurement signal, a multiphase counter configured to provide a count rate for each timing signal corresponding to the plurality of signal cycles over a time period based on the reference frequency signal, and a multiplexer configured to sequentially arrange the count rates in a first series of count rates.

21. The tool of claim 20 further comprising a filter that reduces phase noise from the measurement signal using the first series count rates.

22. The tool of claim 21, wherein the sensor is one of a pressure sensor and a temperature sensor.

* * * * *